US007317288B2

(12) United States Patent
Lin et al.

(10) Patent No.: US 7,317,288 B2
(45) Date of Patent: Jan. 8, 2008

(54) CONTROLLING METHOD AND SYSTEM FOR LED-BASED BACKLIGHTING SOURCE

(75) Inventors: Hsin-Wu Lin, Taoyuan (TW); Jen-Chi Liu, Jhuci Township, Chiayi County (TW); Jyh-Haur Huang, Sinyuan Township, Pingtung County (TW)

(73) Assignee: Au Optronics Corporation, Hsinchu (TW)

( * ) Notice: Subject to any disclaimer, the term of this patent is extended or adjusted under 35 U.S.C. 154(b) by 278 days.

(21) Appl. No.: 11/219,284

(22) Filed: Sep. 2, 2005

(65) Prior Publication Data

US 2007/0052375 A1 Mar. 8, 2007

(51) Int. Cl.
*H05B 37/00* (2006.01)

(52) U.S. Cl. ..... 315/291; 315/312; 315/307

(58) Field of Classification Search ..... 315/291, 315/312, 246, 307, 308, 169.3
See application file for complete search history.

(56) References Cited

U.S. PATENT DOCUMENTS 6,507,159 B2 1/2003 Muthu ..... 315/307
6,963,175 B2 * 11/2005 Archenhold et al. ..... 315/291
2003/0001832 A1 1/2003 Chang ..... 358/518
2003/0076056 A1 4/2003 Schuurmans ..... 315/291
2003/0230991 A1 12/2003 Muthu et al. ..... 315/307

FOREIGN PATENT DOCUMENTS

TW 383122 2/2000
WO WO 2004/057923 7/2004

* cited by examiner

*Primary Examiner*—David H. Vu
(74) *Attorney, Agent, or Firm*—Ware, Fressola Van Der Sluys & Adolphson, LLP

(57) ABSTRACT

The present invention uses different frequencies to drive the LED strips in the back-lighting source so that the spatial uniformity of the back-lighting source as well as the color levels in the source can be monitored and adjusted. Each individual strip is assigned to a different frequency. Alternatively, the strips are divided into groups and each group is assigned to a different frequency. A group may comprise two or more strips. Furthermore, some groups may have more strips than the other groups and the number of LEDs in one strip may be different from the number in other strips. The brightness uniformity and the color levels in the back-lighting source are sensed by one or more groups of color sensors in R, G and B. The assignment of driving frequencies can be based on the location of the strips.

19 Claims, 5 Drawing Sheets

CONTROLLING METHOD AND SYSTEM FOR LED-BASED BACKLIGHTING SOURCE

FIELD OF THE INVENTION

The present invention relates generally to a light source for back-lighting an LCD panel and, more generally, to a method and system for controlling the light source.

BACKGROUND OF THE INVENTION

A display panel such as a transmissive or transflective liquid crystal display (LCD) panel requires a back-lighting source for illumination. Light-emitting devices (LEDs) are commonly used in such a back-lighting source. In particular, LEDs in red, green and blue colors are used to provide a back-light source in "white" color. To illuminate a large LCD panel, many strips of LEDs in different colors are used in a back-light source. The LED strips in different colors are driven by different LED drivers.

In order to control the "whiteness" of the back-lighting source, three sets of sensors are typically used to sense the color brightness level in red, green and blue separately. The sensed color levels are conveyed to a processing means in a feedback control circuit so as to allow the processing means to adjust the color brightness levels through the LED drivers. For example, Muthu et al. (U.S. Patent Application Publication No. 2003/0230991) discloses a feedback circuit wherein photodiodes with color filters are used to send feedback to a microprocessor via a signal conditioning circuit. The microprocessor is programmed to provide signals that control currents from the LED drivers. These signals can take the form of amplitude modulation or pulse width modulation (PWM) so as to change the currents. Chang (U.S. Patent Application Publication No. 2003/0011832) discloses a method for controlling the brightness of the red, green and blue LEDs in a white light source based on the color chromaticity coordinates of the LEDs. Schuurmans (U.S. Patent Application Publication No. 2003/0076056) discloses a color sensing method wherein three sets of color filtered photodiodes and one set of unfiltered photodiodes are used to measure the ratio of the filtered to unfiltered brightness in each color so as to estimate the tristimulus values or the color point of the light source. Based on the difference between the estimated color point and the target color point, a control circuit modifies the driving currents to the color LEDs.

In prior art, the LED driving currents are modified by using pulse-width modulation (PWM) to change the duty cycle of each LED strip while maintaining the same frequency. As illustrated in FIG. 1, the back-lighting source control system 1 comprises a back-lighting source 20 and an LED driving system 10. The back-lighting source 20 contains a plurality of LED strips 24, 26, . . . of different color LEDs driven by a plurality of drivers 14, 16, . . . A sensor 30 is used to sense the color components of the LED strips. Electrical signals indicative of the sensed brightness from the sensor are conveyed to a controller 12 in the LED driving system 10. Upon measuring the color levels in the back-lighting source, the controller adjusts the brightness in the LED strips by changing the duty cycle of the LED drivers 14, 16, . . . using PWM. As illustrated in FIG. 1, although the duty cycle in LED strip #1 may be different from LED strip #2, the driving frequency in the LED strips is the same. For a small back-lighting source, this prior art method may be adequate in adjusting the overall brightness and "whiteness" of the light output. However, a single sensor may not be sufficient in monitoring the uniformity of the light output throughout the back-lighting source. Thus, it may be necessary to place two or more sensors at different sites to sense the color levels at different locations. As shown in FIG. 1, a second sensor 30' is also used to sense the color levels at a different place for improving the output uniformity of the back-lighting source.

The use of multiple sensors increases the cost and the complexity of the monitoring system. It is thus advantageous and desirable to provide a more cost-effective method and a system for color level adjustment and control.

SUMMARY OF THE INVENTION

The present invention uses different frequencies to drive the LED strips in the back-lighting source so that the spatial uniformity of the back-lighting source as well as the color levels in the source can be monitored and adjusted. In one embodiment of the present invention, each individual strip is assigned to a different frequency. In another embodiment, the strips are divided into groups and each group is assigned to a different frequency. A group may comprise two or more strips. Furthermore, some groups may have more strips than the other groups and the number of LEDs in one strip may be different from the number in other strips. The brightness uniformity and the color levels in the back-lighting source are sensed by one or more groups of color sensors in R, G and B, for example. The assignment of driving frequencies can be based on the location of the strips so as to take into account the distance from the LED strips to the sensors.

The present invention will become apparent upon reading the description taken in conjunction with FIGS. 2-4*c*.

DETAILED DESCRIPTION OF THE INVENTION

Figure 1:
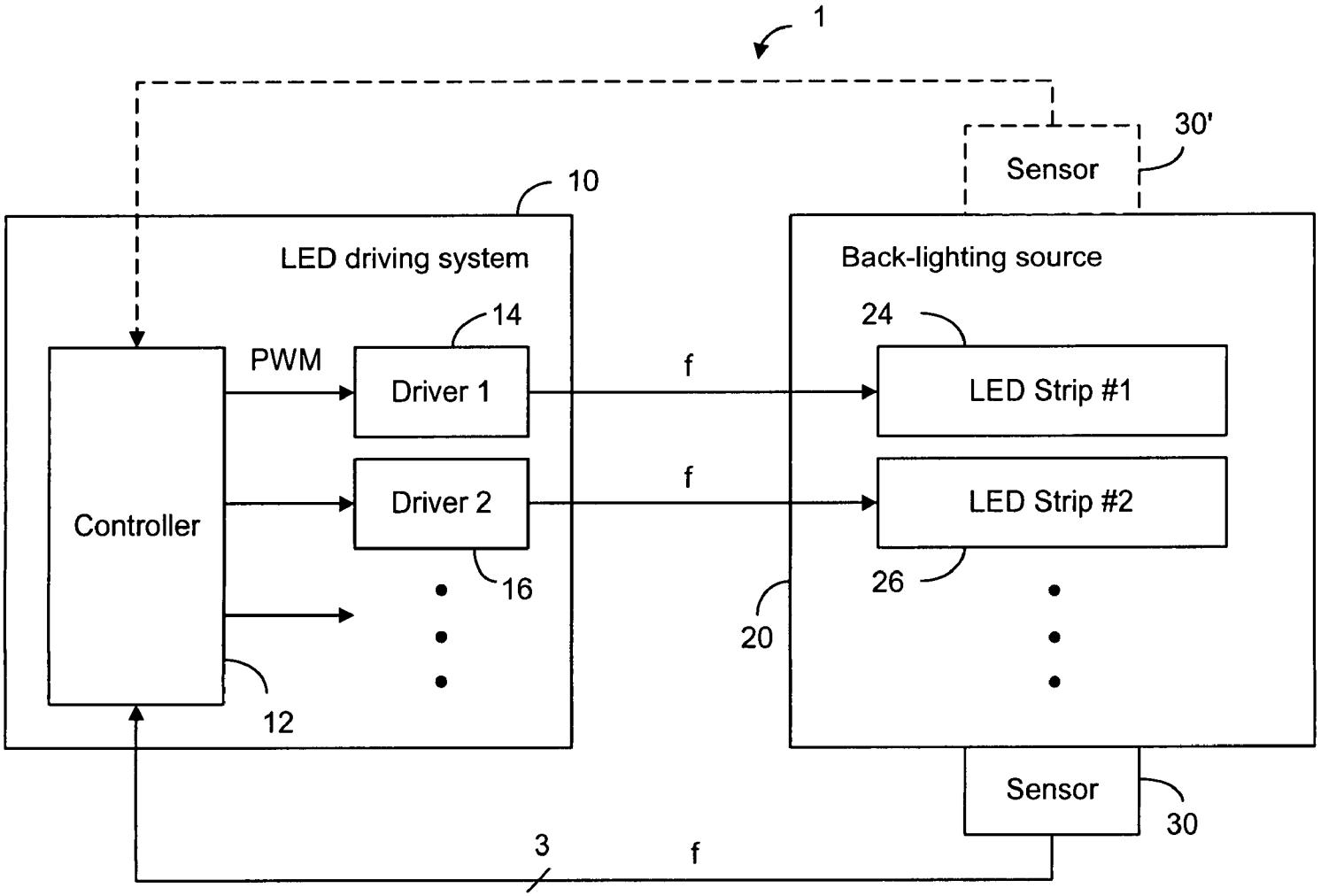
FIG. 1 (prior art)
FIG. 1 is a block diagram showing a prior art system for controlling a back-lighting source.
Figure 2:
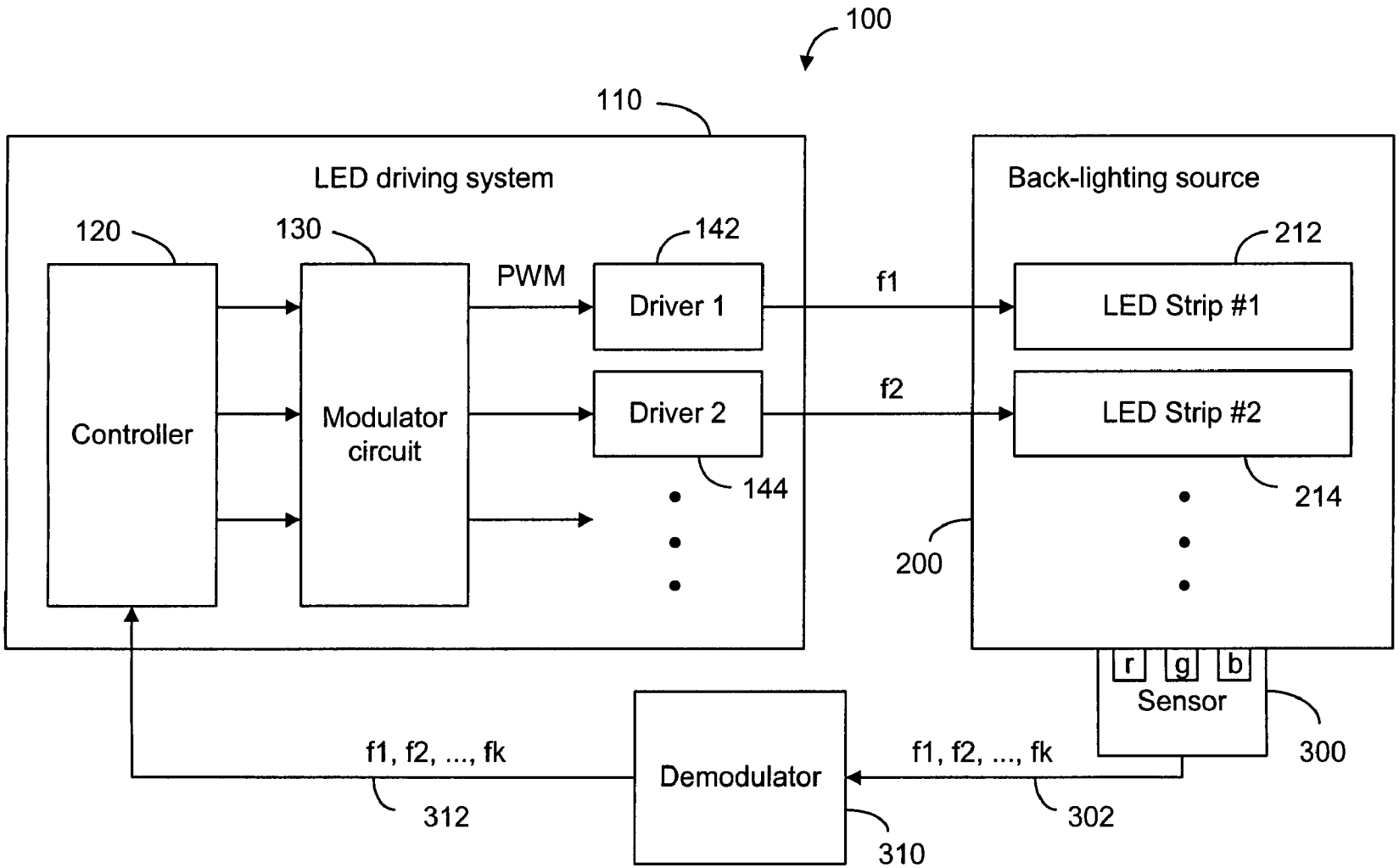
FIG. 2 is a block diagram showing a system for controlling a back-lighting source, according to the present invention.

As with the prior art method, the present invention also uses pulse-width modulation to change the duty cycle in each of the LED strips in order to control the brightness of the LED strips. In contrast to the prior art method, the present invention assigns different frequencies to the LED strips so as to monitor the spatial uniformity of the back-lighting source. As shown in FIG. 2, the back-lighting control system 100, according to the present invention, comprises an LED driving system 100 for driving a back-lighting source 200. The back-lighting source 200 comprises a plurality of LED strips 212, 214, . . . driven by a plurality of LED drivers 142, 144, . . . in the LED driving system 110. A sensor module 300 comprising a plurality of sensors (not shown) sensitive to different color components is used to sense the color levels in the back-lighting source 200. In the LED driving system 110, a controller 120 is used to adjust the brightness of the LED strips 212, 214, . . . by changing the duty cycle of the LED strips through a pulse-width modulator circuit 130. The driving frequency of the LED strip 212 is f1, the driving frequency of the LED strip 214 is f2, etc. As such, the brightness of the LED strip 212 as sensed by the sensor 300 contains the driving frequency f1 as well with the duty cycle of the LED strip 212. Thus, the electrical signals 302 from the sensor 300 contain the color level information of the individual LED strips based on the frequency assignment (f1, f2, . . . , fk) to the strips. Through a calibration process and based on the location of the LED strips in relation to the sensor 300, it is possible to monitor the spatial uniformity in the brightness of the back-lighting source 200.

Figure 2A:
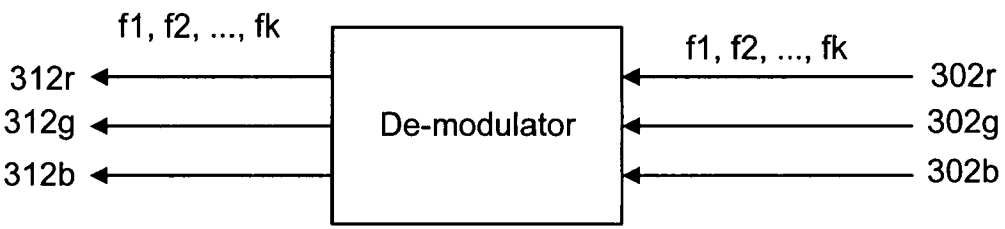
FIG. 2*a* is a block diagram showing a plurality of signal lines for separately carrying sensing signals of different color levels.

It should be noted that the brightness of an LED strip is dependent upon the duty cycle or the pulse width in relation to the frequency. According to the present invention, the controller has the PWM information for each of the frequencies f1, f2, . . . fk. Thus, it is possible to use a demodulation circuit 310 to pre-process the sensor signals 302 into modulated signals 312 before conveying the sensed information to the controller 120. However, it is also possible to combine the demodulation function of the demodulation circuit 310 in the controller 120 or within the LED driving system 110. It is advantageous to have different signal lines to carry the sensor signals of different colors. For example, modulated sensor signals 302*r*, 302*g* and 302*b* are separately carried in three signal lines to the demodulation circuit so as to provide separate demodulated sensor signals 312*r*, 312*g* and 312*b*, as shown in FIG. 2*a*.

Figure 3:
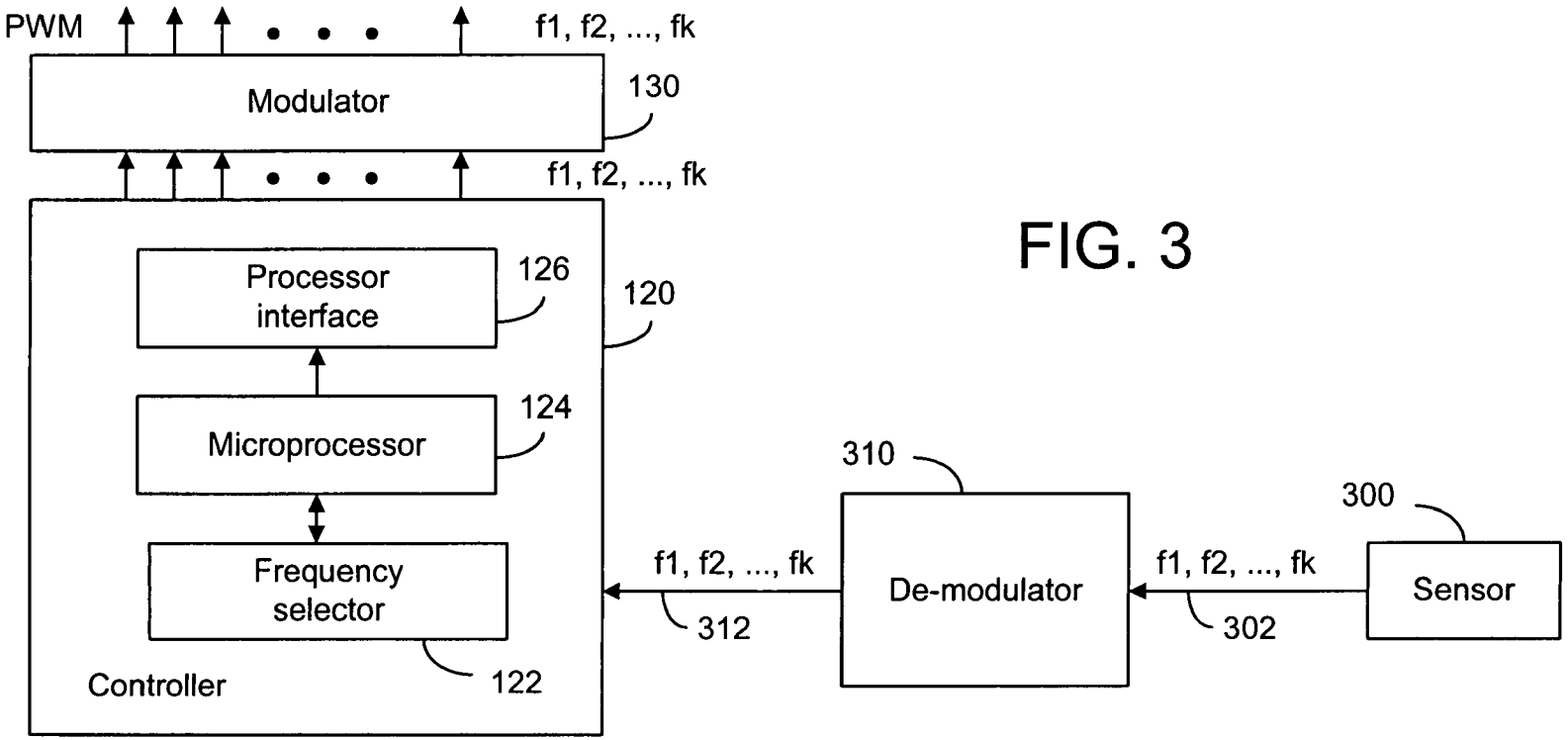
FIG. 3 is a schematic representation illustrating the principle of signal processing and control using a microprocessor.

Referring to FIG. 3, for illustration purposes only, the controller 120 contains a frequency selector 122 which can be used to select the sensed signal of a particular frequency so that the brightness of a particular LED strip can be estimated by the microprocessor 124. For example, when the frequency f2 is selected by the frequency selector 122, the brightness information associated with the LED strip 214 can be obtained by the microprocessor 124. With the PWM information related to the frequency f2, the microprocessor 124 takes into consideration the duty cycle of the LED strip 214 when estimating the brightness. By separately measuring the brightness of the LED strips through frequency selection, the microprocessor 124 can estimate the color balance in the output of the back-lighting source 200 and the brightness uniformity. As shown in FIG. 3, the microprocessor 124, through an interface circuit 126, adjusts the brightness of the LED strips by changing the duty cycle as carried out by the modulator 130.

Figure 4B:
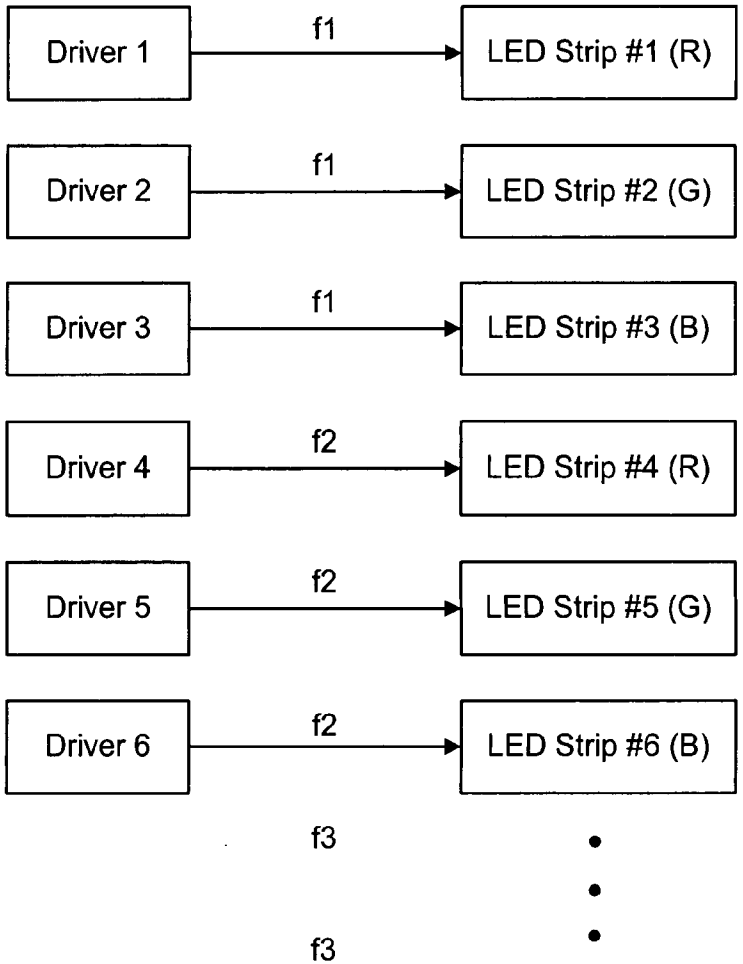
FIGS. 4*a* to 4*c* show different ways in assigning driving frequencies among the LED strips.
Figure 4A:
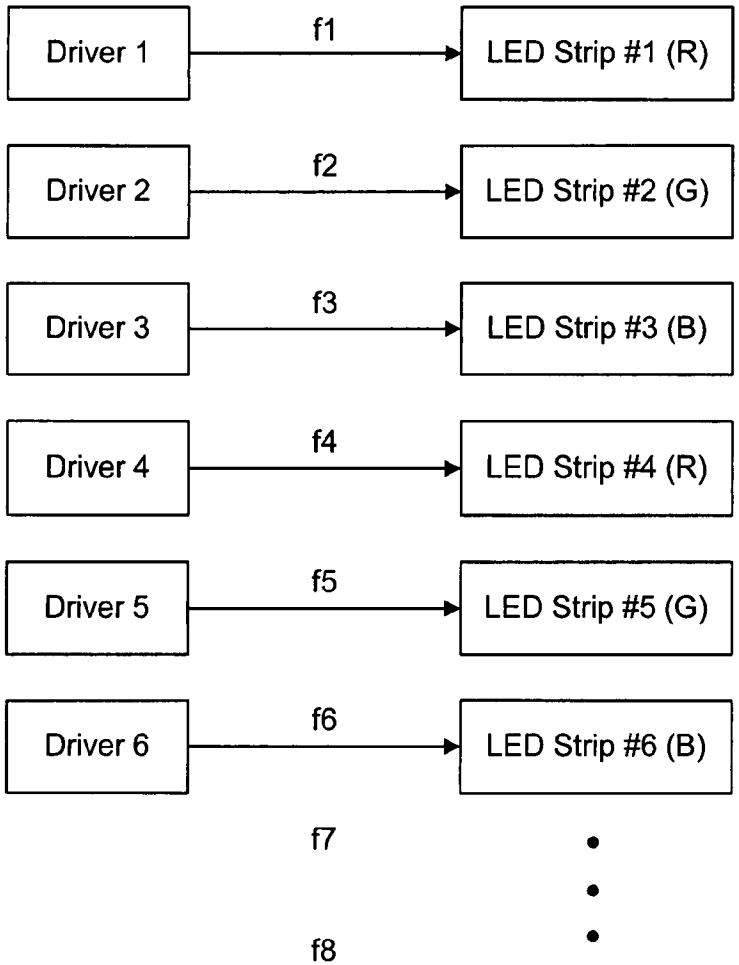

As shown in FIG. 4*a*, it is preferable to assign a different driving frequency f to a different LED strip. As such, the microprocessor 124 (see FIG. 3) can recognize the color of a particular strip based on the assigned frequency. For example, through the frequency selector 122, the microprocessor 124 is able to single out the sensed signal associated with the red LED strip #4 by selecting the frequency f4.

It is possible to assign one frequency to a group of three LED strips of different colors, as shown in FIG. 4*b*. As such, it is possible to monitor the spatial uniformity in the brightness of the back-lighting source. However, it is necessary to use three different signal lines to convey the sensed signals to the controller, each line for a different color, as shown in FIG. 2*a*.

Figure 4C:
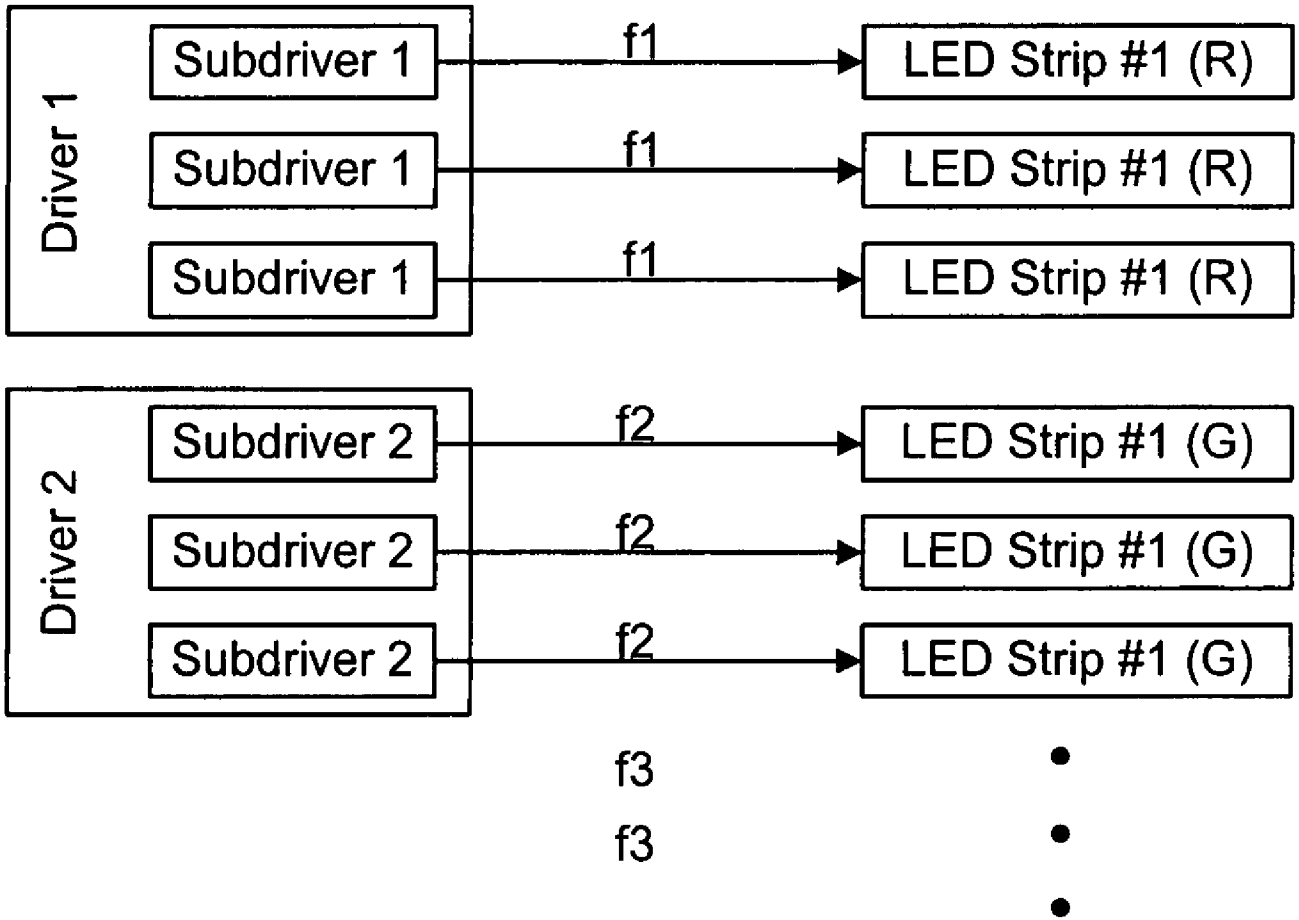

Moreover, it is possible to assign the same frequency to two or more LED strips of the same color, as shown in FIG. 4*c*, if these LED strips are disposed close to each other and the distances from the sensor 300 to these LED strips do not change significantly. It is also possible to assign the driving frequencies to the LED strips based on the distances from the sensor 300 to the LED strips.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method to improve the brightness uniformity in a light source having a plurality of light-emitters divided into a plurality of emitter groups, each group driven by an electrical current to produce light having a light intensity level, said method comprising the steps of:

embedding frequency information in the electrical currents driving the light-emitters in each emitter group;

sensing the light produced by the emitter groups for providing a signal indicative of the sensed light, the sensed light having the embedded frequency information;

determining from the signal the light intensity level of each emitter group based on the embedded frequency information; and adjusting the electrical currents driving the emitter groups based on the determined light intensity level.

2. The method of claim 1, wherein each of the emitter groups is disposed in a different location in the light source and the embedded frequency information contains information identifying the locations of the emitter groups so that said adjusting is also based on the locations of the emitter groups.

3. The method of claim 1, wherein at least some of the electrical currents driving the emitter groups are provided in current pulses having a pulse width and said adjusting is carried out by changing the pulse width in the electrical currents.

4. The method of claim 1, wherein the light-emitters comprise light emitters in a plurality of colors and the sensed light comprises a plurality of sensed light color components indicative of colors of the light-emitters, and wherein said adjusting is also based on the colors of the light emitters.

5. The method of claim 1, wherein the electrical currents driving the emitter groups are assigned to a plurality of driving frequencies for providing the embedded frequency information and wherein said determining is based on the driving frequencies carried in the sensed light.

6. The method of claim 5, wherein at least some of the emitter groups are further divided such that each group comprises a plurality of emitter strips such that the currents driving the strips in each group have the same driving frequency.

7. A light source driving apparatus for use in a lighting system comprising a light source having a plurality of light-emitters, the light-emitters divided into a plurality of emitter groups, said driving apparatus comprising:

a driving module having a plurality of drivers for providing electrical currents to the emitter groups to produce light having a light intensity level, each electrical current having a driving frequency; and a controlling module for determining the light intensity level of the emitter groups based on driving frequency information associated with the light intensity level in order to adjust the electrical currents provided by the drivers based on the determined light intensity level of the emitter groups.

8. The light source driving apparatus of claim 7, further comprising:

a light sensing module disposed in relation to the light source to sense the light produced by the emitter groups for providing a signal indicative of the sensed light, the sensed light containing the driving frequency information.

9. The light source driving apparatus of claim 7, wherein the emitter groups are disposed in different locations in the light source and the driving frequency is associated with a location such that the electrical currents are adjusted also based on the locations of the emitter groups.

10. The light source driving apparatus of claim 7, further comprising a modulation module operatively connected to the driving module for modulating the electrical currents in the emitter groups into a pulse form having a series of pulses, the pulses having a pulse width, wherein the modulation module is also operatively connected to the controller so as to allow the controller to adjust the electrical currents provided by the driving module by changing the pulse width.

11. The light source driving apparatus of claim 10, wherein the sensed light is in the pulse form indicating of said modulating, said system further comprising:

a demodulation module, operatively connected to the light sensing module, for demodulating the signal prior to said determining.

12. The light source driving apparatus of claim 8, wherein the light-emitters comprise light emitters in a plurality of colors and the light produced by the light-emitter groups contains a plurality of color components, and wherein the light sensing module comprises a plurality of sensing elements for sensing the color components to provide the sensed light.

13. The light source driving apparatus of claim 12, wherein the electrical currents are adjusted based on the colors of the light-emitters.

14. A lighting system comprising:

a light source having a plurality of light-emitters divided into a plurality of emitter groups;

a driving module having a plurality of drivers for providing electrical currents to the emitter groups to produce light having a light intensity level, each electrical current having a driving frequency;

a light sensing module disposed in relation to the light source to sense the light produced by the emitter groups for providing a signal indicative of the sensed light, the sensed light containing information of the driving frequencies; and a controlling module, responsive to the signal, for determining the light intensity level of the emitter groups based on the driving frequency information so as to adjust the electrical currents provided by the drivers based on the determined light intensity level of the emitter groups.

15. The lighting system of claim 14, wherein the emitter groups are disposed in different locations in the light source and the driving frequency is associated with a location such that the electrical currents are adjusted also based on the locations of the emitter groups.

16. The lighting system of claim 14, further comprising a modulation module operatively connected to the driving module for modulating the electrical currents in the emitter groups into a pulse form having a series of pulses, the pulses having a pulse width, wherein the modulation module is also operatively connected to the controller so as to allow the controller to adjust the electrical currents provided by the driving module by changing the pulse width.

17. The lighting system of claim 16, wherein the sensed light is in the pulse form indicating of said modulating, said system further comprising:

a demodulation module, operatively connected to the light sensing module, for demodulating the signal prior to said determining.

18. The lighting system of claim 14, wherein the light-emitters comprise light emitters in a plurality of colors and the light produced by the light-emitter groups contains a plurality of color components, and wherein the light sensing module comprises a plurality of sensing elements for sensing the color components to provide the sensed light.

19. The lighting system of claim 18, wherein the electrical currents are adjusted based on the colors of the light-emitters.

* * * * *

UNITED STATES PATENT AND TRADEMARK OFFICE

CERTIFICATE OF CORRECTION

PATENT NO. : 7,317,288 B2
APPLICATION NO. : 11/219284
DATED : January 8, 2008
INVENTOR(S) : Lin et al.

It is certified that error appears in the above-identified patent and that said Letters Patent is hereby corrected as shown below:

Title Page, item [56] col. 2,

In "References Cited", Chang should be --2003/0011832--.0

Signed and Sealed this

Third Day of June, 2008

JON W. DUDAS
*Director of the United States Patent and Trademark Office*